US009307813B2

(12) United States Patent
Bruce

(10) Patent No.: US 9,307,813 B2
(45) Date of Patent: Apr. 12, 2016

(54) STRETCH WATER BOTTLE COMPARTMENT

(71) Applicant: Karsten Manufacturing Corporation, Phoenix, AZ (US)

(72) Inventor: Ryan J. Bruce, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 14/259,554

(22) Filed: Apr. 23, 2014

(65) Prior Publication Data

US 2015/0108182 A1 Apr. 23, 2015

Related U.S. Application Data

(60) Provisional application No. 61/891,983, filed on Oct. 17, 2013.

(51) Int. Cl.

| | |
|---|---|
| ***A63B 55/00*** | (2015.01) |
| ***A45C 3/00*** | (2006.01) |
| ***A45C 13/00*** | (2006.01) |
| *A45F 3/00* | (2006.01) |

(52) U.S. Cl.

CPC ..... *A45C 3/001* (2013.01); *A45C 13/00* (2013.01); *A63B 55/00* (2013.01); *A63B 55/408* (2015.10); *A45C 2200/20* (2013.01); *A45F 2003/001* (2013.01); *A45F 2200/0583* (2013.01); *A63B 2209/10* (2013.01); *A63B 2209/14* (2013.01); *A63B 2225/68* (2013.01); *Y10T 29/49826* (2015.01)

(58) Field of Classification Search

CPC ..... A45F 3/20; A45F 2200/0583; A45C 2200/20; A45C 3/001; Y10S 224/926

USPC ..... 224/148.1–148.7, 926

See application file for complete search history.

(56) References Cited

U.S. PATENT DOCUMENTS

| | | | | |
|---|---|---|---|---|
| 4,257,463 | A | 3/1981 | Monaco | |
| 4,729,417 | A | 3/1988 | Brierley | |
| 5,341,928 | A | 8/1994 | Jones et al. | |
| 5,402,883 | A | 4/1995 | Shin | |
| D403,504 | S | 1/1999 | Breth | |
| 5,890,809 | A * | 4/1999 | Nelson | 383/40 |
| D440,040 | S | 4/2001 | Cantasano | |
| D458,756 | S | 6/2002 | Smith | |
| 2003/0042091 | A1 * | 3/2003 | Oh | 190/111 |
| 2004/0144819 | A1 | 7/2004 | Huang | |
| 2007/0267454 | A1 * | 11/2007 | Baiz | 224/901.8 |
| 2008/0047986 | A1 * | 2/2008 | Will et al. | 224/148.3 |
| 2008/0164165 | A1 * | 7/2008 | McGuire et al. | 206/315.3 |
| 2010/0059559 | A1 * | 3/2010 | Given | 224/222 |
| 2010/0102096 | A1 * | 4/2010 | Willows et al. | 224/148.1 |
| 2013/0098954 | A1 * | 4/2013 | Inglis | 224/148.4 |
| 2013/0219590 | A1 * | 8/2013 | Tweedie | 2/247 |

* cited by examiner

*Primary Examiner* — Justin Larson
*Assistant Examiner* — Scott McNurlen

(57) ABSTRACT

Embodiments of a compartment are generally described herein. A compartment for use with a bag wherein the compartment includes a first panel configured to be coupled to the bag. The first panel defines at least a portion of a pocket, has a longitudinal axis, and forms a cutout. The compartment also includes a second panel coupled to the first panel. The second panel covers the cutout, and includes a first material stretchable along a first axis perpendicular to the longitudinal axis and a second material stretchable along the first axis and a second axis that is parallel to the longitudinal axis. Other embodiments may be described and claimed.

9 Claims, 12 Drawing Sheets

STRETCH WATER BOTTLE COMPARTMENT

CROSS-REFERENCE TO RELATED APPLICATIONS

This claims priority to U.S. patent application Ser. No. 61/891,983, filed on Oct. 17, 2013, the entire contents of which are fully incorporated herein by reference.

FIELD

The present disclosure relates to a compartment to receive and secure an object having a variable size to a bag, and in particular, to golf bags.

BACKGROUND

Water may be obtained in many forms. Aside from bottled water, other beverages such as milk, sodas, juices, and sports drinks, among others, are good sources of water and help people stay hydrated. Each of these beverages, including bottled water, may be served in a container have any configuration (i.e., shape and size) and that hold a wide variety of fluid volumes. Many bags and carrying mechanisms are not configured to accommodate the numerous container options that are available to carry hydrating beverages. Therefore, it is not surprising that because people are busy in their daily activities and beverage containers are cumbersome to carry, recent studies are finding that people are water deficient, which can lead to decreased performance and fatigue, particularly during exercise.

BRIEF DESCRIPTION OF THE DRAWINGS

Corresponding reference characters indicate corresponding elements among the various views of the drawings. The headings used in the figures should not be interpreted to limit the scope of the claims.

DESCRIPTION

Before any embodiments of the apparatus, methods, and articles of manufacture are explained in detail, it is to be understood that this disclosure is not limited in its application to the details of construction and the arrangement of components set forth in the following description or illustrated in the following drawings. The apparatus, methods, and articles of manufacture described herein may include other embodiments and may be practiced or carried out in various ways.

Water plays a critical role in the human body, which is made up of about 60 percent water. Further, each cell and system within the body relies on water to function optimally. For example, water is responsible for regulating body temperature, heart rate, and blood pressure. Water loss through sweat and other bodily functions prevent people from staying optimally hydrated. Water serves an even more pivotal role before, during, and after exercising. For example, a single golf round may take several hours, and therefore, often times golfers rely on water and other fluids to stay hydrated throughout the round. As such there, there is a need to make carrying hydrating beverages easier and less cumbersome thereby encouraging people to stay hydrated.

Figure 9:
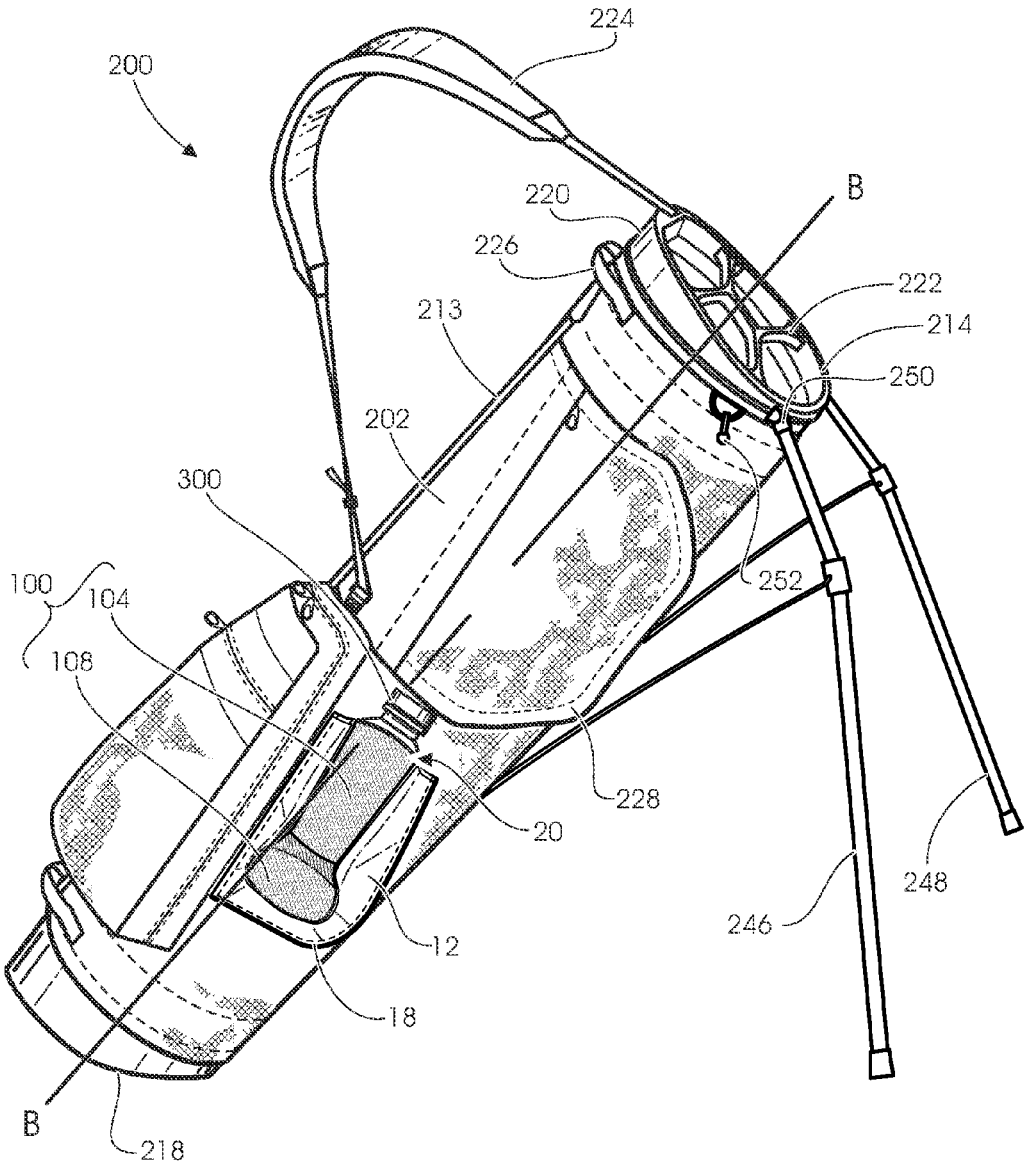
FIG. 9 is a perspective view of a golf bag, the first panel of the compartment of FIGS. 1-4 coupled to a body of the golf bag.

FIGS. 1-4 illustrate a compartment 10 for use with a bag (e.g., one shown as 200 in FIG. 9). As will be discussed in detail herein the compartment 10 secures beverage containers of any type to any type of bag thereby making carrying hydrating beverages easier and less cumbersome. The compartment 10 defines at least a portion of a pocket 18 that, as will be discussed in greater detail below, includes a multi-material system that has a series of different materials containing unique stretch capabilities. The compartment 10 includes a first panel 12 having a longitudinal axis A that extends between a first end 14 and a second end 16. The first panel 12 defines at least a portion of the pocket 18 and includes an opening 20. The first panel 12 also includes a cutout 26. In the illustrated embodiment, the cutout 26 is substantially symmetrical about the longitudinal axis A and includes a first side 30 and a second side 34. Each of the first side 30 and the second side 34 include a straight portion 38, 42, a linear portion 46, 50, and an arcuate portion 54, 58. The straight portions 38, 42 of each of the first and the second sides 30, 34 are oriented parallel to one another and define a first cutout portion 62. The arcuate portions 54, 58 of each of the first and second sides 30, 34 are connected to define a closed end 66 of the cutout. Together with the linear portions 46, 50, the arcuate portions 54, 58 define a second cutout portion 70. The cutout 26 is, therefore, shaped like the bottom of an hourglass. In additional or alternative embodiments, the cutout 26 may have other shapes and configurations.

The compartment 10 further includes a second panel 100 that is coupled to the first panel 12 and covers the cutout 26. The second panel 100 extends between the first end 14 of the first panel 12 and the closed end 66 of the cutout 26. The second panel 100 includes a first material 104 and a second material 108. At least a portion of second material 108 overlaps the first material 104. The first material 104 is coupled to the first panel 12 such that it covers the first cutout portion 62 and at least a portion of the second cutout portion 70. The second material 108 is coupled to the first panel 12 such that is covers the second cutout portion 70 and at least a portion of the first cutout portion 62. The first material 104 is coupled to the first panel 12 independently of the second material 108. Further, although the second material 108 overlaps the first material 104, the first material 104 is not coupled to the second material 108. As will be discussed in greater detail below, overlapping the first material 104 with the second material 108, but not securing the first material 104 to the second material 108, allows the first and second materials 104, 108 to stretch independently of one another giving the compartment 10 a greater degree of flexibility. Additionally, because the two materials are not secured to one another, the manufacturing process is simpler and more cost effective.

Figure 1:
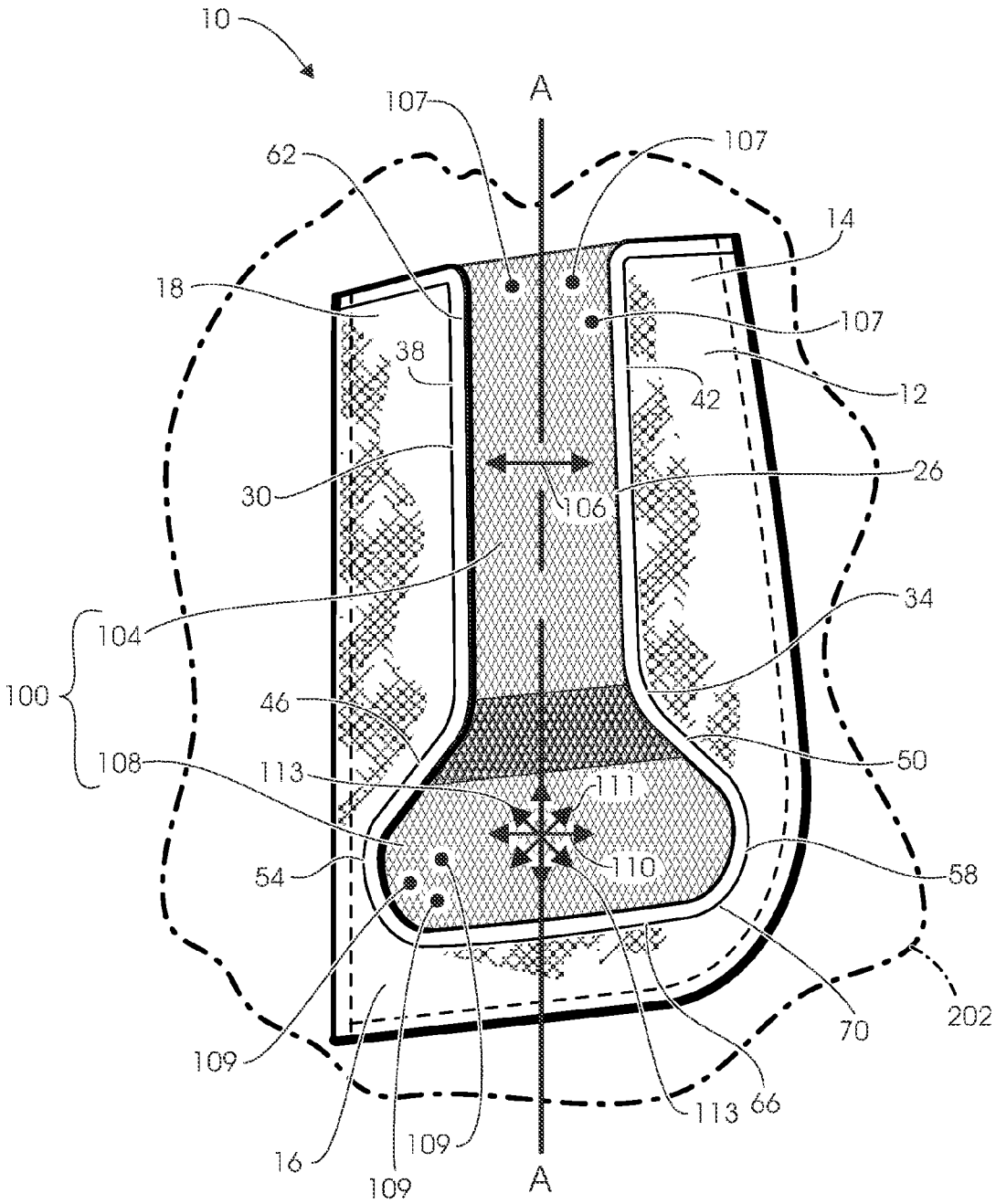
FIG. 1 is a front view of a compartment according to a first embodiment of the apparatus, methods, and articles of manufacture described herein, the compartment including a first panel defining at least a portion of a pocket and a second panel, the pocket illustrated in a compressed position.
Figure 2:
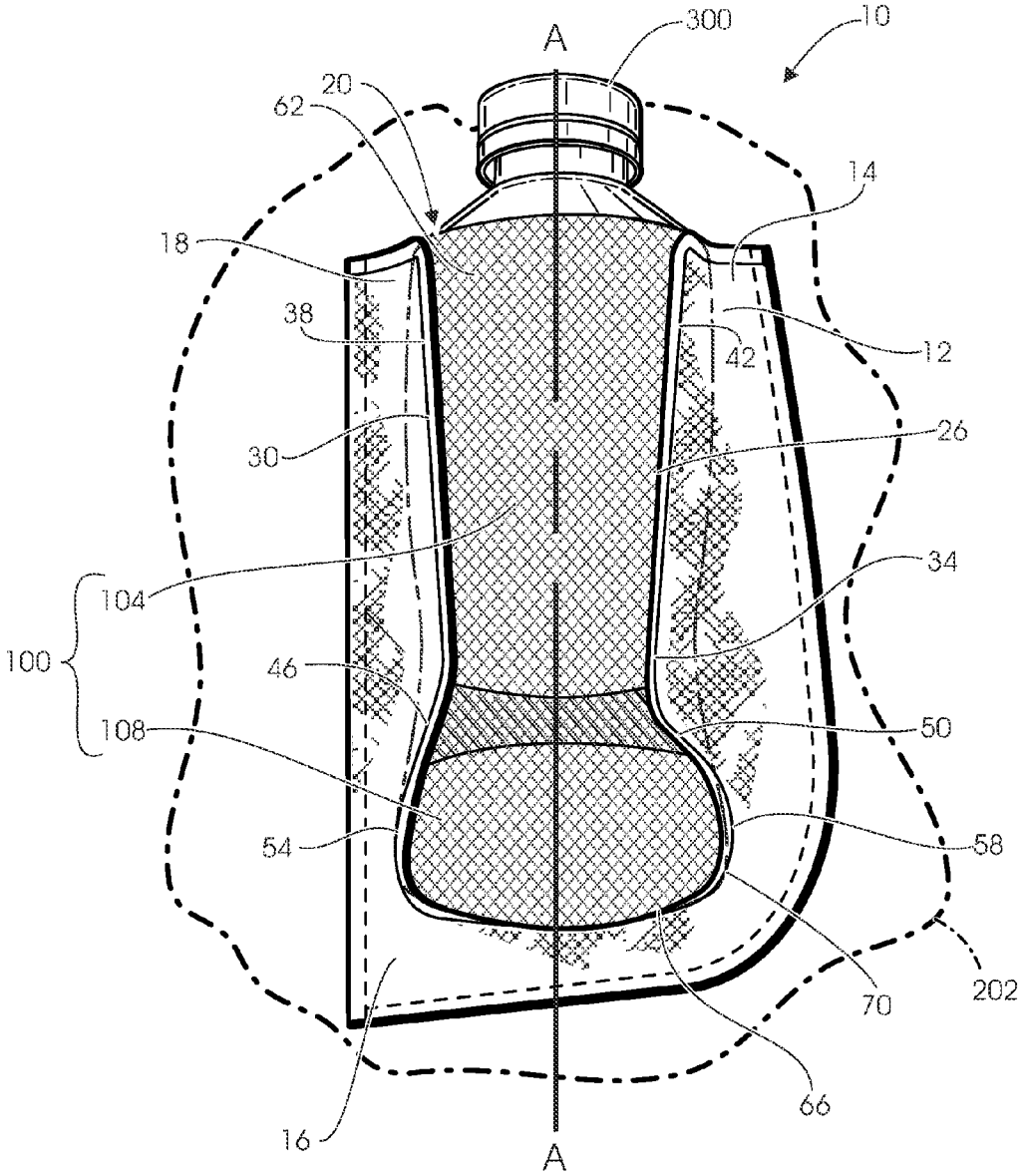
FIG. 2 is a front view of the compartment of FIG. 1, but illustrating the pocket in an expanded position.
Figure 3:
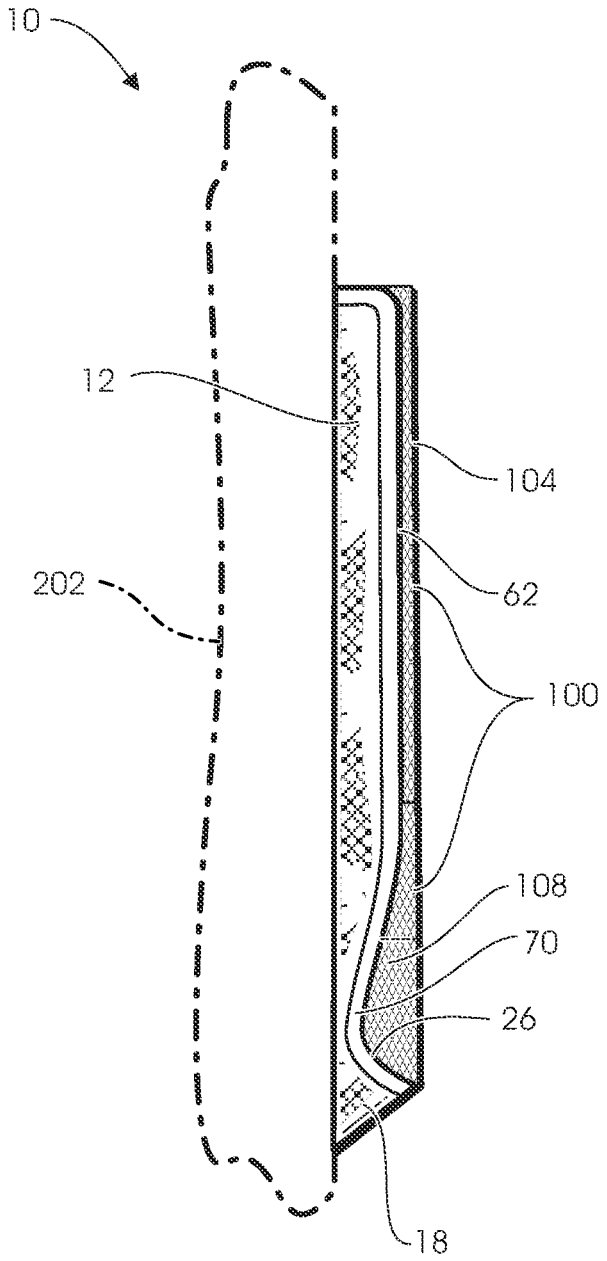
FIG. 3 is a side view of the compartment of FIG. 1 and illustrating the pocket in the compressed state of FIG. 1.
Figure 4:
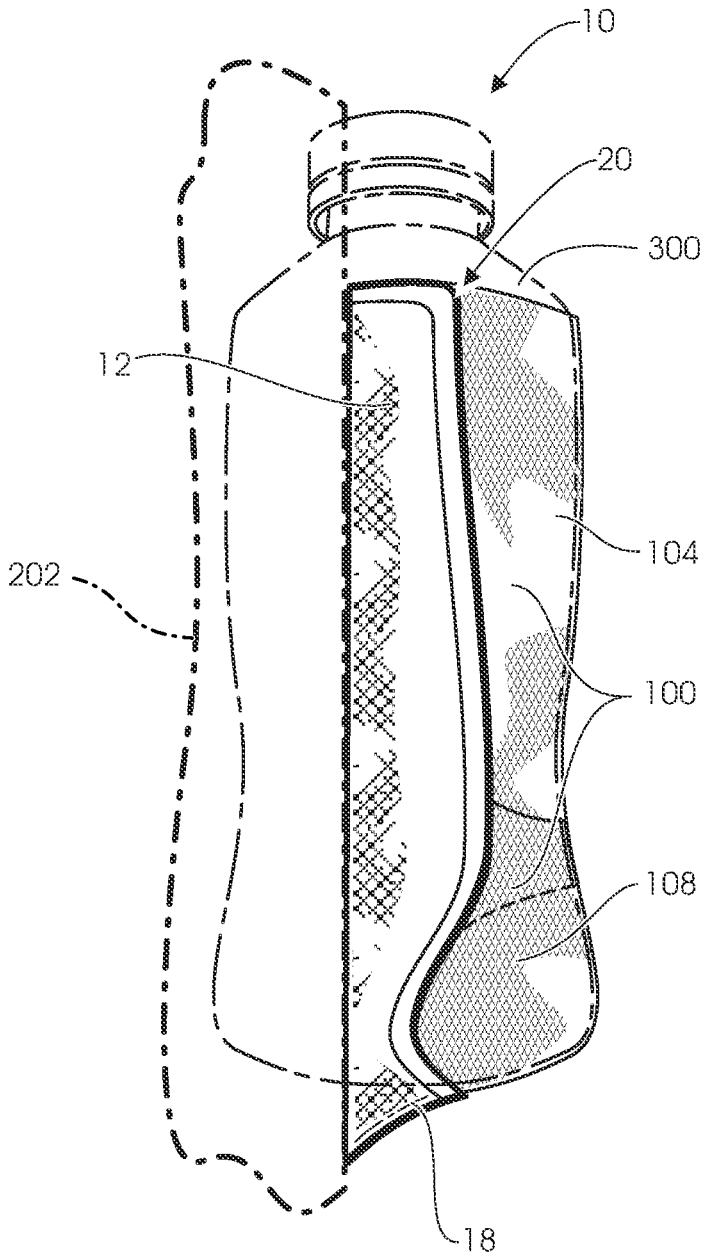
FIG. 4 is a side view of the compartment of FIG. 1 and illustrating the pocket in the expanded state of FIG. 2.
Figure 5:
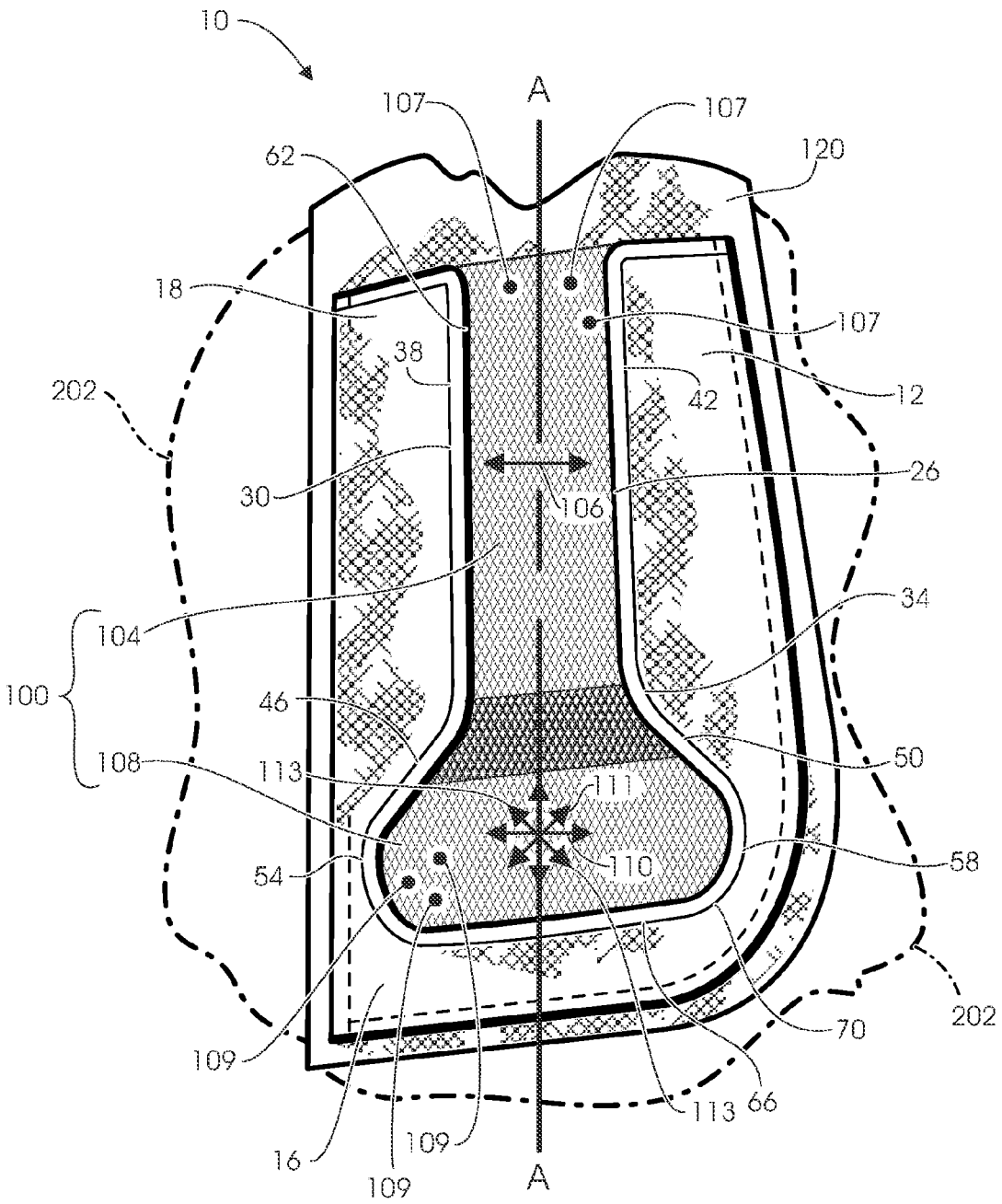
FIG. 5 is a front view of a compartment according to another embodiment of the apparatus, methods, and articles of manufacture described herein, the compartment including a first panel defining at least a portion of a pocket, a second panel, and illustrating the first panel coupled to a third panel, the pocket illustrated in a compressed position.
Figure 6:
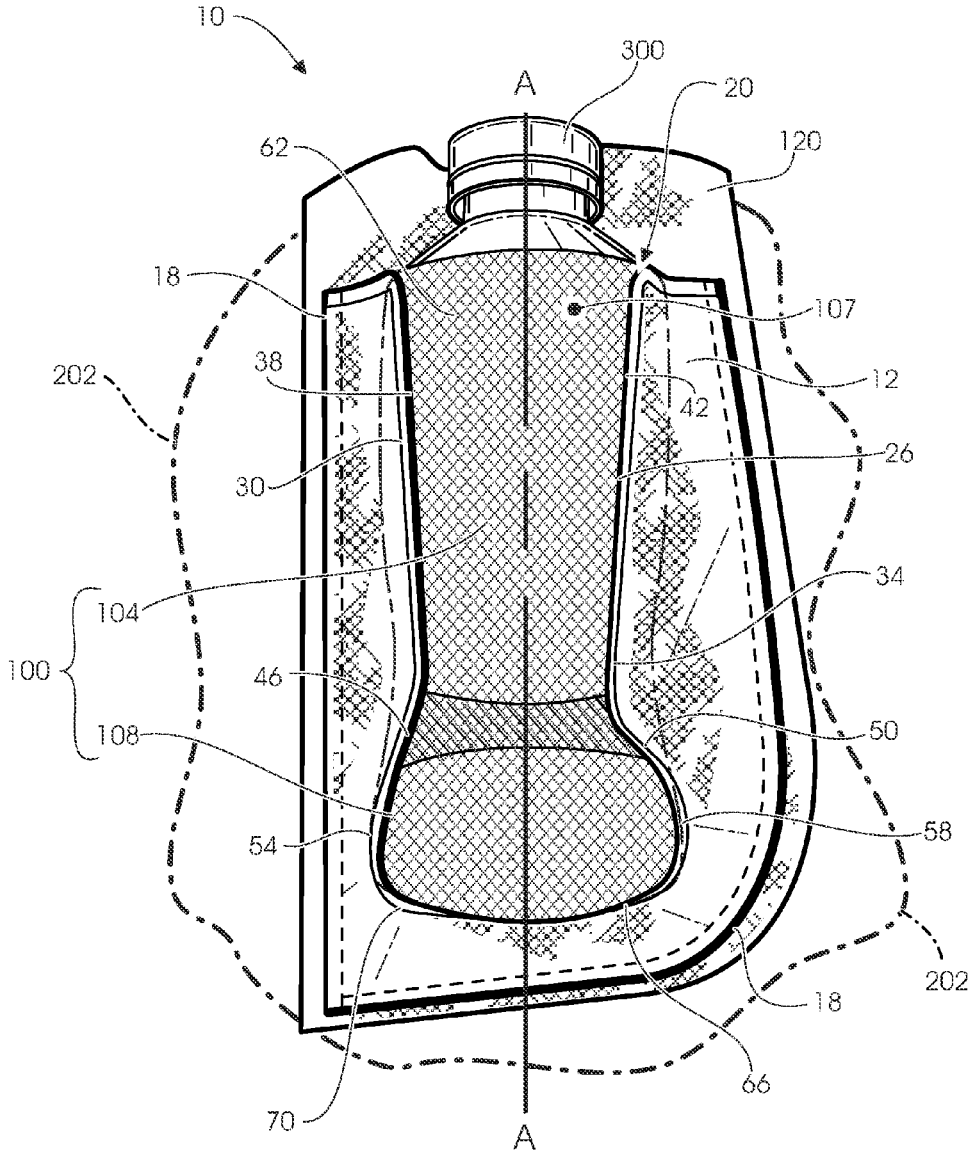
FIG. 6 is a front view of the compartment of FIG. 5, but illustrating the pocket in an expanded position.
Figure 7:
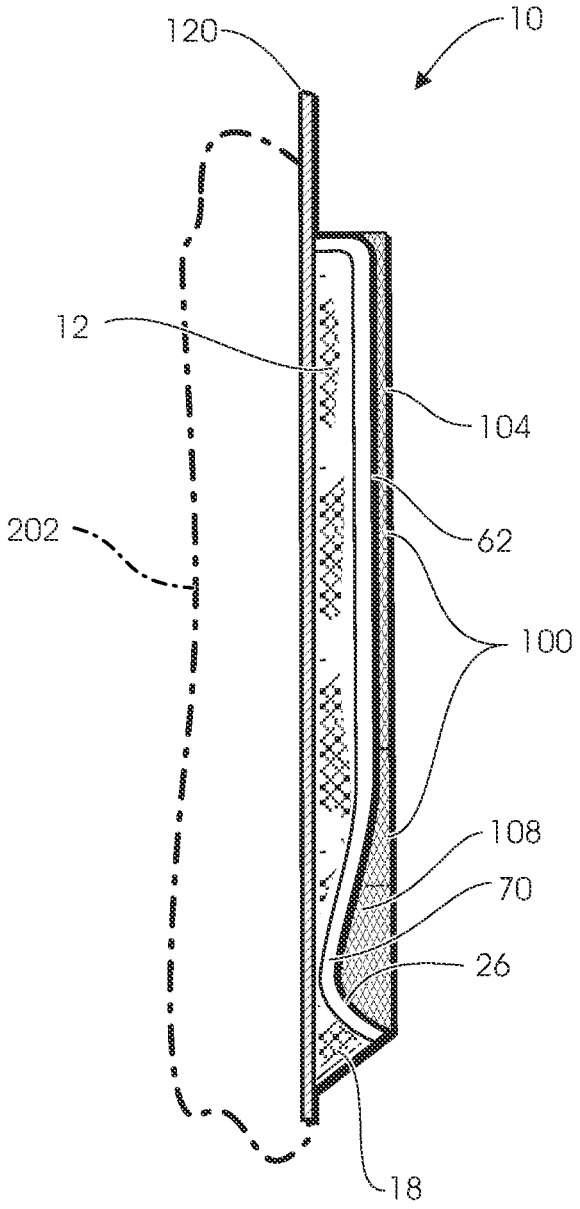
FIG. 7 is a side view of the compartment of FIG. 5 and illustrating the pocket in the compressed state of FIG. 5.
Figure 8:
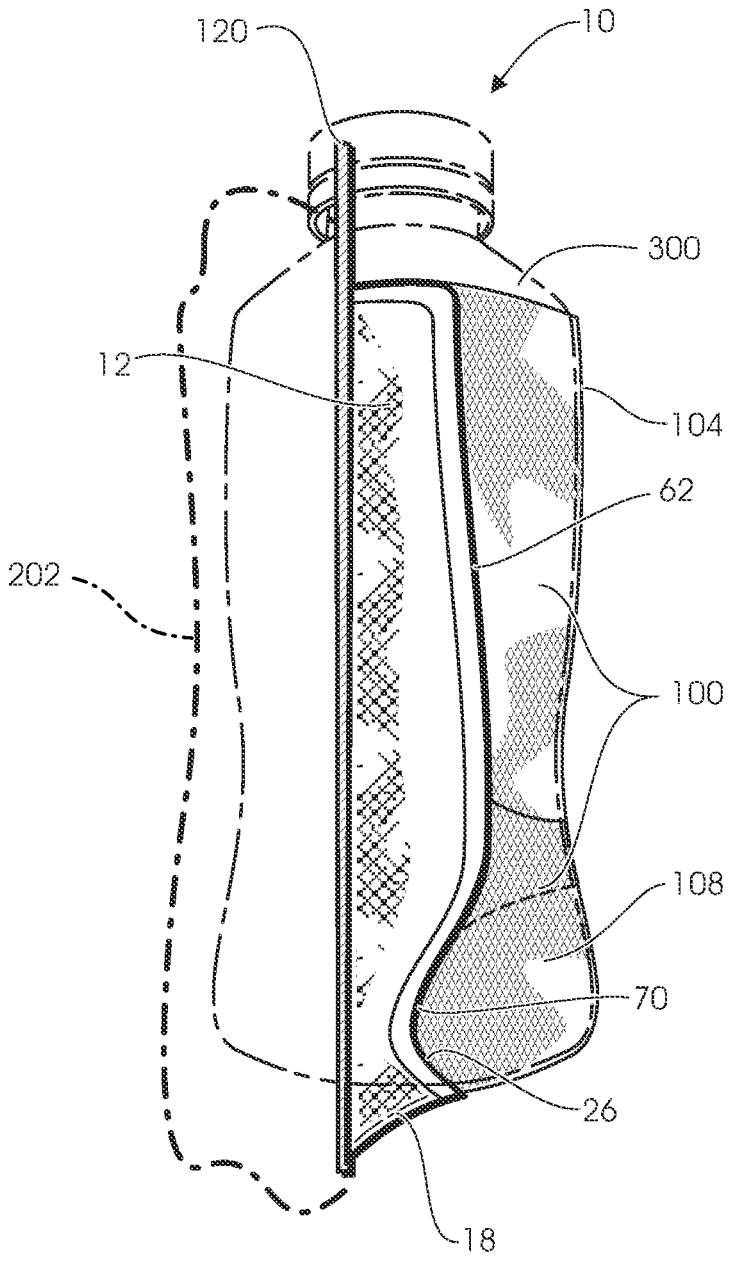
FIG. 8 is a side view of the compartment of FIG. 5 and illustrating the pocket in the expanded state of FIG. 5.

The first material 104 is stretchable in two directions (i.e., in both directions as indicated by arrow 106). In the illustrated embodiment, the first material 104 stretches substantially horizontally along an axis that is parallel to arrow 106, which, as illustrated in FIG. 1, is perpendicular to the longitudinal axis A. As an illustration, each fiber 107 that makes up the first material is capable of stretching horizontally and in either direction indicated by the double-headed arrow 106. The second material 108 is stretchable in four directions (i.e., in both directions as indicated by arrow 110 and in both directions indicated by arrow 111). The second material 108 stretches substantially horizontally along the axis that is parallel to arrows 106 and 110 and also, substantially vertically along an axis that is parallel to arrow 111, which, as illustrated in FIG. 1, is parallel to the longitudinal axis A. As an illustration, each fiber 109 that makes up the second material 108 is capable of stretching horizontally and in either direction indicated by the double-headed arrow 110 or vertically and in either direction indicated by the double-headed arrow 111. The fiber 109 is, therefore, inherently able to stretch diagonally along axes in between the arrows 110, 111, as indicated by arrows 13, for example. In additional or alternative embodiments, the first material 104 and second material 108 may be configured to be stretchable along different axes relative to the longitudinal axis or may include varying degrees of stretch. Additionally, it is contemplated that other embodiments of the second panel 100 may be made up of additional materials (i.e., third and/or fourth materials) covering portions of each of the first and second cutout portions 62, 70.

The above-described construction of the compartment 10 may be coupled to any type of bag. For example, the bag may be any bag such as a backpack, purse, grocery bag, suitcase, travel bag, compartment bag, computer bag, or a golf bag (e.g., one shown as 200 in FIG. 9). The compartment 10 may also be coupled to the bag by any suitable method. In one example, the compartment 10 may be sewn onto the bag. Alternatively, the compartment 10 and the bag may include any type of mating fastener (not shown), such as a zipper, Velcro, snap buttons, or the like. The apparatus, methods, and articles of manufacture described herein are not limited in this regard. Therefore, together with the bag, the compartment forms the pocket 18 for receiving an object (i.e., a beverage container or water bottle 300). The compartment 10, and therefore the pocket 18, affords several advantages. First, overlapping the first material 104 with the second material 108 allows the same to stretch independently of one another such that the pocket 18 has a variable degree of flexibility to receive and secure all types of bottles 300. The shape of the cutout 26 and the second panel 100 and the first and second materials 104, 108 are also important and unique to the function of the pocket 18. The half-hourglass shape of the second panel 100 allows the second material 108 that makes up the bottom of the pocket 18 to better fit around the bottom portion of the bottle 300. In other words, the second material 108 allows the pocket 18 more freedom by pulling the first panel 12 and the second panel 100 away from the bag allowing the second material 108 to conform to varying shapes of the bottom portion of the bottle 300. In contrast, the first material 104 that makes up the top of the pocket 18 remains smaller in width therefore confining the bottle 300 against the bag. As such, the pocket 18 retains the bottle 300 without any type of closure mechanism such as a zipper, Velcro, or magnet or the like, which aids in ease of use because the bottle 300 merely slides in and out of the pocket 18 upon a force imparted by the user. Additionally, the lack of a closure mechanism reduces the cost of parts and manufacturing. Therefore, the compartment 10 uses the above-described configuration and first and second materials 104, 108 to achieve proper flexibility and conformity to an object such as the bottle 300 when in use, and relative obscurity when not in use. In other words, the compartment 10 achieves the goal of keeping the pocket 18 flat against the bag when not in use, but also has the flexibility to selectively expand to its proper size when the bottle 300 is inserted in the pocket 18. This is also important because the bottle 300, when received by the pocket 18, extends from the bag rather than encroaching on interior space of the bag. The compartment 10 also allows a pocket 18 to be used with any bag without taking away from the aesthetic of the bag. For example, when not in use, the pocket 18 is flat giving the bag a cleaner, sleeker look. Additionally, the compartment 10 requires less material, space, and hardware so that the compartment 10 may be placed anywhere on the bag more easily, at a reduced cost, and without adding unnecessary weight to the bag.

An exemplary implementation of the compartment 10 is illustrated in FIG. 9. It should be understood that the compartment 10 functions similarly no matter what type of bag is used. The bag is a golf bag 200 having a generally tubular body 202 that includes a housing 213 extending between an open, top portion 214 and a closed, bottom portion 218. The top portion 214 may be located on a top end of the body 202, and the bottom portion 218 may be located opposite of the top portion 214 on the bottom end of the body 202. A longitudinal axis D of the golf bag 200 is defined between the top portion 214 and the bottom portion 218. The housing 213 may be formed of nylon or other lightweight fabric and is adapted to receive one or more golf clubs (shown in broken lines). A ring-shaped member such as a throat 220 is stitched or otherwise mounted to the top portion 214 of the body 202. The throat 220 includes a plurality of dividers 222 that segregate golf clubs with the golf clubs being inserted into and removed from the bag 200 through the throat 220. The bottom portion 218 may be rigid and similarly mounted to the bottom end of the body 202. Both the bottom portion 218 and the throat 220 may be molded or otherwise formed of a suitable synthetic resin in a manner well known in the art. Additional features normally associated with golf bags such as a shoulder strap 224, a handle 226, at least one compartment pocket 228 and/or a towel attachment mechanism 252 may also be included in the of the golf bag 200.

Further, the golf bag 200 may include a generally rigid spine (not shown) interconnects the throat 220 and the bottom portion 218 to keep the throat 220 and the bottom portion 218 in a spaced-apart relationship. The spine may be made of wood, fiberglass or other suitable rigid lightweight material. Lower end of the spine may be attached by a hinge to the bottom portion 218 by means of a length of fabric or other flexible material forming a fabric hinge which permits the bottom portion 218 to pivot relative to spine. As can be determined from the foregoing, the side of the body 202 diametrically opposite the spine is partially collapsible because the spine extends along only one side of the golf bag 200. Therefore, when placed upright resting on the bottom portion 218, the golf bag 200 may collapse such that the bag is supported by legs 246, 248 as shown in FIG. 1.

The golf bag 200 further includes an automatically extensible stand with a U-shaped actuator rod (not shown), the lower end of which is attached to a bearing (not shown) formed in the bottom portion 218. The actuator rod has two upward extending arms 238, 240. The upper ends of arms 238 and 240 are pivotally attached to collars 242, 244 formed on the legs 246, 248, respectively. The legs 246, 248 are themselves pivotally attached to at least one hinge or bearing 250 formed on the throat 218.

Further with respect to FIG. 9, the first panel 12 is coupled to body 202 of the golf bag 200 such that the second panel 100, which is coupled to the first panel 12, is disposed opposite the body 202. Therefore, the first panel 12, the second panel 100, and the body 202, together, define the pocket 18. When in use, the second panel 100 is selectively stretchable to expand the pocket 18. The compartment 10 may be placed anywhere on the body 202 of the golf bag 200.

Figure 10:
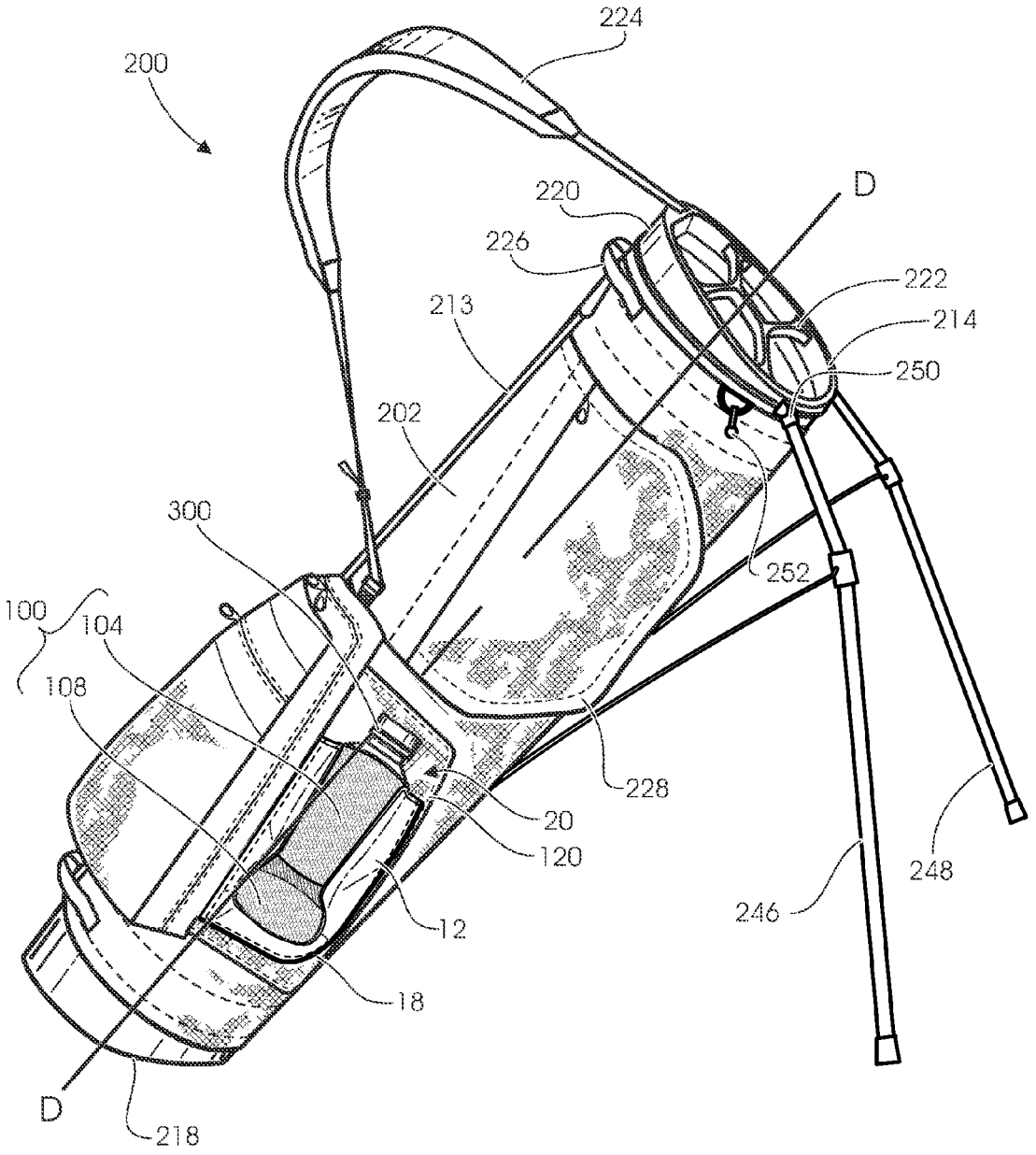
FIG. 10 is a perspective view of the golf bag of FIG. 9, but illustrating the third panel of the compartment of FIGS. 5-8 coupled to the body of the golf bag.

In an alternate embodiment illustrated in FIGS. 5-8 and 10, a third panel 120 may be coupled to the first panel 12 to define a side 116 of the pocket 18 opposite the second panel 100. The third panel 120 is coupled adjacent to the body 202 of the golf bag 200 (FIG. 10). The third panel 120 is coupled to body 202 of the golf bag 200 such that the second panel 100, which is coupled to the first panel 12, is disposed opposite the third panel 120. Therefore, the third panel 120 is coupled to the body 202 of the bag 200 such that the first panel 12, the second panel 100, and the third panel 120, together, define the pocket 18. As discussed above with respect to FIG. 9, when in use, the second panel 100 is selectively stretchable to expand the pocket 18. The third panel 120 may be the same material or a different material than either the first panel 12 or the material that makes up the body 202 of the golf bag 200. The compartment 10 may be placed anywhere on the body 202 of the golf bag 200.

Figure 11:
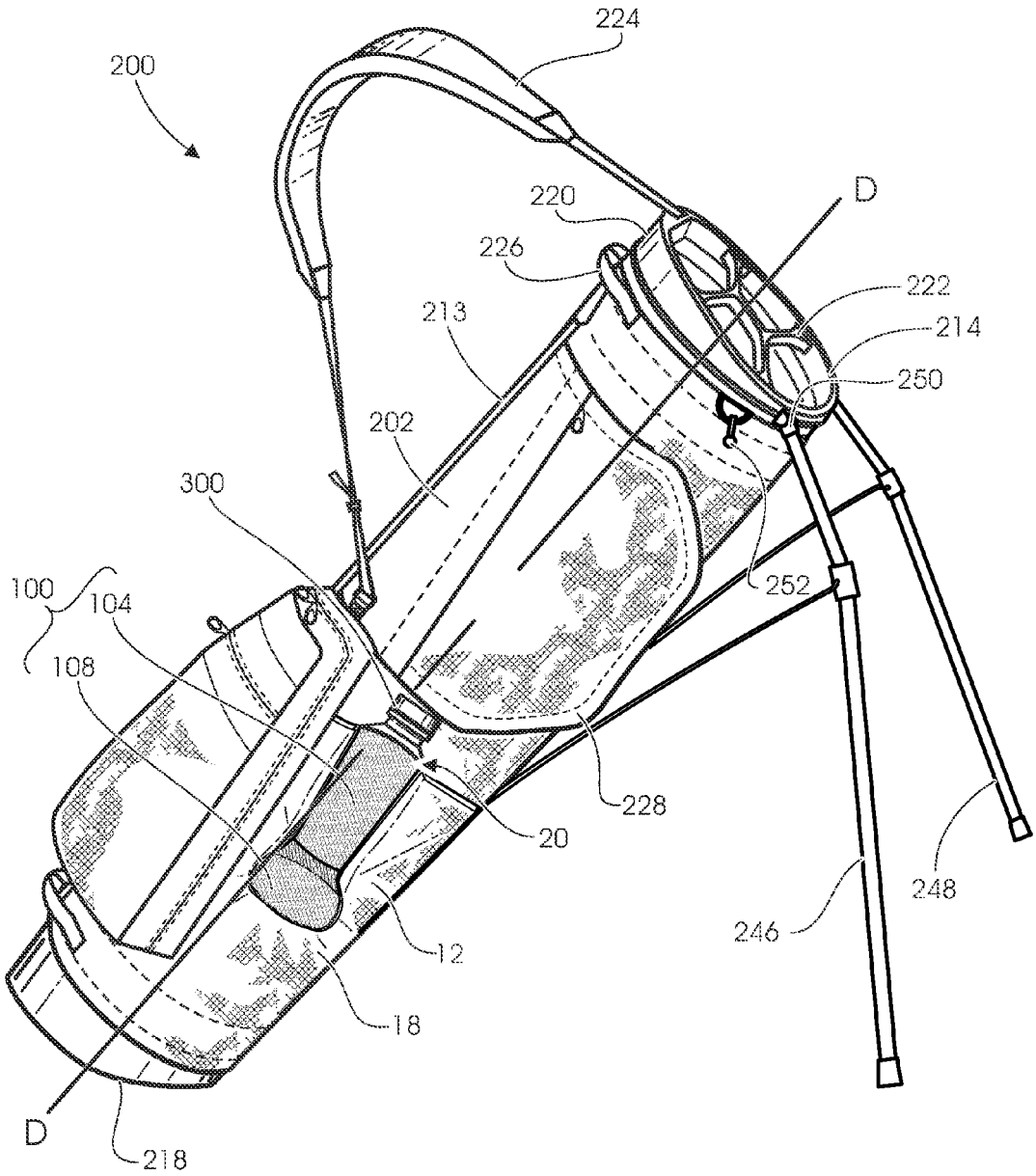
FIG. 11 is a perspective view of golf bag of FIG. 9, but illustrating the first panel being integrally formed with the body of the golf bag.

In another alternative embodiment illustrated in FIG. 11, the pocket 18 may be integrally formed with the body 202 of the bag 200. In other words, the first panel 12 is formed with the outer surface of the body 202 of the golf bag 200. Therefore, the first panel 12 may be formed of the same material as the material that makes up the body 202 of the bag 200. Therefore, the second panel 100 is attachable to first panel 12, which allows the first panel to stretch with respect to the body 202 of the golf bag 200. As discussed above with respect to FIG. 9, when in use, the second panel 100 is selectively stretchable to expand the pocket 18. The first panel 12 may be formed with any portion of the body 202 of the golf bag 200 such that the compartment 10 may be integrally formed anywhere on the body 202 of the golf bag 200.

The pocket 18 created by the compartment 10 includes a first, compressed state in which the second panel 100 is substantially unstretched (FIGS. 1, 3, 5, and 7). When in the compressed state, the first and second panels 14, 100 lie flat against the body 212 of the bag 200 such that when not in use, the compartment 10 is relatively obscure (e.g., not extended outwardly). The first material 104 and second material 108 second panel 100 enable the first panel 12 to lie flat against the body 212 even without any type of closure mechanism (i.e., Velcro, a zipper, or the like).

The pocket 18 further includes a second, expanded state in which the second panel 100 is stretched to selectively expand pocket 18 (FIGS. 2, 4, 6, and 8). Because the first and second materials 104, 108 of the second panel 100 are not secured to one another, the materials 104, 108 are able to stretch independently of one another. As such, the second panel 100 allows the pocket 18 to receive and conform to the bottle 300 that may have any shape or configuration. The second material 108 allows the first panel 12 to be pulled away from the bag 200, and further conforms to the shape of a bottom of the bottle 300. The first material 104 constricts the opening 20 thereby securing the bottle 300 against the bag 200. The pocket 18, therefore, is selectively stretchable to expand the pocket to receive and secure a first object and a second object larger than the first object within the pocket at different times. As such, the pocket 18 has the ability to receive and constrain a water bottle, for example, having a first configuration, and to receive and constrain a water bottle, for example, having a second configuration. The first and second configurations may have different shapes and be shaped differently yet the same pocket 18 is able to accommodate both, as well as other objects that may have any other alternative configuration. Additionally, when in the second state, the pocket 18 is displaced away from the bag 200 such that the bottle 300 projects outwardly from the bag 200 when received within the pocket 18. The bottle 300, therefore, does not encroach on an interior space of the bag 200 yet is secured thereto.

To use the compartment 10, the user slides the bottom of the bottle 300 through the opening 20 in the pocket 18. As the bottle 300 moves from the first end 14 of the first panel 12 to the second end 16 of the first panel 12, the first material 104 followed by the second material 108 stretch to accommodate a width of the bottle. When the bottom of the bottle 300 is positioned adjacent the second end 16, the second material 108 conforms to the bottom of the bottle 300 and the first material 104 presses the bottle 300 against the bag 200. To remove, the user slides bottle 300 from the second end 16 to the first end 14 through the opening 20. Once the bottle 300 is no longer received by the pocket 18, the first and second materials 104, 108 of second panel 100 contract such that the first panel 12 lies flat against the bag 200.

Figure 12:
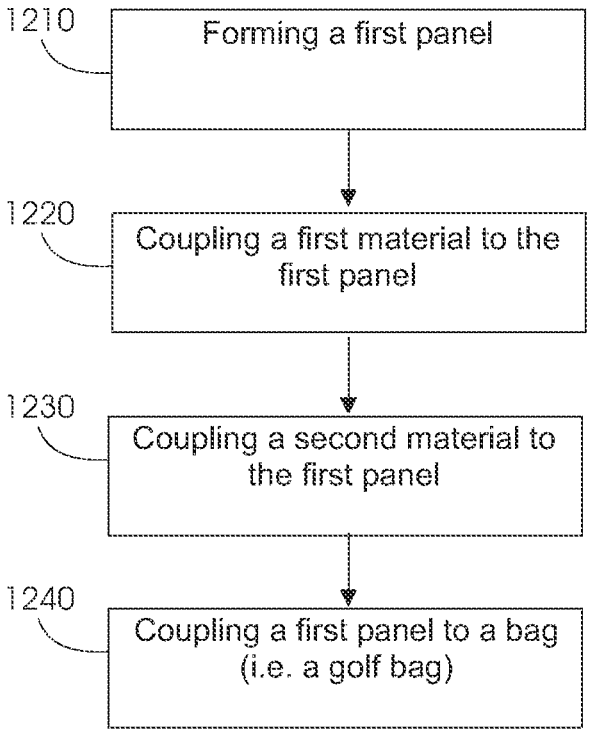
FIG. 12 illustrates a flowchart of a method for manufacturing a compartment in accordance with examples and embodiments of the present disclosure.

FIG. 12 illustrates a flowchart of a method 1200 for providing or manufacturing a compartment for use with a bag. To manufacture the compartment 10, the first panel 12 is formed at block 1210. At block 1220, the first material 104 is coupled to the first panel 12 to cover the first cutout portion 62 of the cutout 26. Accordingly, at block 1230, the second material 108 is coupled to the first panel 12 to cover the second cutout portion 70 of the cutout 26. The second material 108 is coupled over (i.e., overlaps) at least a portion of the first material 104. In the illustrated embodiment, compartment 10 is auxiliary and is, therefore, manufactured independently of the bag 200. As such, at block 1240, the compartment 10 is added to the body 212 of the bag 200 in a separate step. The compartment 10 may be coupled to the bag 200 by any suitable fastening mechanism. For example, the first panel 12 of FIGS. 1-4 and 9 (or the third panel 120 of FIGS. 5-8 and 10) may be fastened to the body 202 of the bag 200 by sewing the first panel 12 of FIGS. 1-4 and 9 (or the third panel 120 of FIGS. 5-8 and 10) onto the bag 200. Alternatively, the first panel 12 (or the third panel 120) may be coupled using fasteners (i.e., Velcro, snap fasteners, a zipper, and the like). It is also contemplated that the first panel 12 may be integrally formed with the body 212 of the bag 200 rather than being an independent structure, which is illustrated in FIG. 11. The method show in flowchart 1200 and described above is merely exemplary. There can be other methods where different blocks of the method 1200 can be combined into a single block or performed simultaneously and/or the sequence of such blocks can be changed. There can also be examples where method 1200 can comprise further or different blocks.

Other variations can be implemented for method 1200 without departing from the scope of the present disclosure.

The compartment 10 requires few steps when inserting and removing the bottle 300 from the pocket 18 while keeping the pocket 18 out of the way and tight against the bag when not in use. The pocket 18 is free of hardware, making the bag 200 lighter and more cost efficient, and giving the bag 200 a cleaner look when the pocket 18 is not in use. The pocket 18, can be located in a variety of places on the bag 200 because the compartment 10 requires less space. Moreover, unlike discrete pockets which extend inward toward the interior of the bag, the pocket 18 remains discrete without compromising interior space.

While the figures may depict particular compartment 10 and bag 200, respectively, the apparatus, methods, and articles of manufacture described herein are not limited in this regard.

It should be understood from the foregoing that, while particular embodiments have been illustrated and described, various modifications can be made without departing from the spirit and scope of the disclosure as will be apparent to those skilled in the art. Such changes and modifications are within the scope and teachings of this disclosure as defined in the claims appended hereto.

Various features and advantages of the apparatus, methods, and articles of manufacture described herein are set forth in the following claims.

What is claimed is:

1. A bag comprising:

a body defining a housing extending between a bottom portion and a top portion, the housing adapted to receive one or more golf clubs;

a first panel configured to be coupled to the body, wherein the first panel defines at least a portion of a pocket, has a longitudinal axis, and forms a cutout; and a second panel coupled to the first panel and covering the cutout, the second panel including a first material stretchable along a first axis perpendicular to the longitudinal axis and a second material stretchable along the first axis and a second axis that is parallel to the longitudinal axis, wherein at least a portion of the second material overlaps a portion of the first material to cover the cutout and the first material and second material are independently coupled to the first panel.

2. The bag of claim 1 further comprising a third panel coupled to the first panel to define a side of the pocket opposite the seconds panel.

3. The bag of claim 1, wherein the first material stretches in two directions and the second material stretches in four directions.

4. The bag of claim 1, wherein the second panel is selectively stretchable to expand the pocket to receive and secure a first object and a second object larger than the first object within the pocket at different times.

5. The bag of claim 1, wherein the pocket includes:

a compressed state in which the second panel is substantially unstretched; and an expanded state in which the second panel is stretched to selectively expand the pocket.

6. The bag of claim 1, wherein the pocket includes:

a compressed state in which the first panel and second panel are substantially flat against a body of the bag; and an expanded state in which the pocket is selectively expanded to receive and secure an object such that the object projects from the body of the bag.

7. A method of manufacturing a compartment for use with a bag, the method comprising:

forming a first panel configured to be coupled to the bag, wherein the first panel defines at least a portion of a pocket, has a longitudinal axis, and forms a cutout; and coupling a first material to the first panel to cover a first portion of the cutout, the first material being stretchable along a first axis perpendicular to the longitudinal axis of the first panel;

coupling a second a second material to the first panel to cover a second portion of the cutout, the second material being stretchable along the first axis and a second axis that is parallel to the longitudinal axis;

wherein the first material and the second material together form a second panel that covers the cutout with the first material and second material independently coupled to the first panel; and coupling the first panel to a body of a golf bag.

8. The method of claim 7, wherein coupling the second material to the first panel includes overlapping at least a portion of the first material with at least a portion of the second material.

9. The method of claim 7, wherein coupling the second panel includes configuring the second panel to be selectively stretchable to expand the pocket to receive and secure a first object and a second object larger than the first object within the pocket at different times.

* * * * *